US011480121B2

(12) United States Patent
Matsushima et al.

(10) Patent No.: US 11,480,121 B2
(45) Date of Patent: Oct. 25, 2022

(54) CONTROLLER AND CONTROL METHOD FOR INTERNAL COMBUSTION ENGINE

(71) Applicant: Mitsubishi Electric Corporation, Tokyo (JP)

(72) Inventors: Yuhei Matsushima, Tokyo (JP); Tatsuhiko Takahashi, Hyogo (JP); Junichi Inoue, Tokyo (JP); Toshikatsu Saito, Tokyo (JP); Kazuhiro Tokuyama, Tokyo (JP); Kazuyo Kako, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/503,483

(22) Filed: Oct. 18, 2021

(65) Prior Publication Data

US 2022/0220910 A1 Jul. 14, 2022

(30) Foreign Application Priority Data

Jan. 14, 2021 (JP) ..... JP2021-003910

(51) Int. Cl.
*F02D 41/00* (2006.01)
*F02P 5/15* (2006.01)
*F02D 13/02* (2006.01)

(52) U.S. Cl.
CPC ..... *F02D 41/009* (2013.01); *F02D 13/0215* (2013.01); *F02D 41/0047* (2013.01); *F02P 5/15* (2013.01); *F02D 2200/021* (2013.01); *F02D 2200/024* (2013.01); *F02D 2200/04* (2013.01)

(58) Field of Classification Search
CPC ..... F02D 41/009; F02D 41/0047; F02D 13/0215; F02D 2200/021; F02D 2200/024; F02D 2200/04; F02P 5/15
USPC ..... 123/435, 436; 701/110, 111; 73/114.04, 73/114.11, 114.26
See application file for complete search history.

(56) References Cited

U.S. PATENT DOCUMENTS 10,215,111 B2 * 2/2019 Hagari ..... F02D 41/26

FOREIGN PATENT DOCUMENTS

JP 6029726 B1 11/2016

* cited by examiner

*Primary Examiner* — Hai H Huynh
(74) *Attorney, Agent, or Firm* — Sughrue Mion, PLLC; Richard C. Turner

(57) ABSTRACT

To provide a controller and a control method for internal combustion engine which can reduce arithmetic load, while suppressing deterioration in the estimation accuracy of the parameter relevant to the combustion state, even if the error component of high frequency is included in the crank angle acceleration. A controller for internal combustion engine, by referring an unburning condition data, calculates a shaft torque in unburning in the vicinity of the top dead center in the burning condition; calculates an external load torque based on calculated shaft torque in unburning and the actual shaft torque in burning in the vicinity of the top dead center; calculates a shaft torque in unburning by referring the unburning condition data; calculates an increment of gas pressure torque by burning based on the shaft torque in unburning, the actual shaft torque in burning, and the external load torque.

13 Claims, 8 Drawing Sheets

| θd | ··· | −4 | 0 | 4 | ··· | 176 | 180 | 184 | ··· |
|---|---|---|---|---|---|---|---|---|---|
| Tork_mot | ··· | ○○ | ○○ | ○○ | ··· | ○○ | ○○ | ○○ | ··· |

SETTING VALUE

CONTROLLER AND CONTROL METHOD FOR INTERNAL COMBUSTION ENGINE

INCORPORATION BY REFERENCE

The disclosure of Japanese Patent Application No. 2021-003910 filed on Jan. 14, 2021 including its specification, claims and drawings, is incorporated herein by reference in its entirety.

BACKGROUND

The present disclosure relates to a controller and a control method for internal combustion engine.

In order to improve the fuel consumption performance and the emission performance of the internal combustion engine, the method of measuring the combustion state of the internal combustion engine and carrying out feed of the measuring result is effective. For that purpose, it is important to measure the combustion state of the internal combustion engine accurately. It is known widely that the combustion state of the internal combustion engine can be measured accurately by measuring a cylinder pressure. As the measurement method of cylinder pressure, besides the method of measuring directly based on the cylinder pressure sensor signal, there is the method of estimating the gas pressure torque based on the information on each mechanism of the internal combustion engine, such as the crank angle signal.

As the conventional technology, for example, JP 6029726 B discloses the combustion state estimation apparatus which estimates the combustion state based on the output signal of the crank angle sensor. In the combustion state estimation apparatus disclosed in JP 6029726 B, as shown in the equation (15) of JP 6029726 B, using the shaft torque calculated based on the crank angle speed and the inertia (the first term of numerator on the right side of the equation (15)), the gas pressure torque by plural unburning cylinders calculated based on the cylinder pressure of each unburning cylinder estimated by the pressure in the intake pipe and the like (the second term of numerator on the right side of the equation (15)), the reciprocation inertia torque by the reciprocating movement of the piston of each cylinder calculated based on the crank angle acceleration (the third term of numerator on the right side of the equation (15)), and the external load torque applied to the crankshaft from the outside of the internal combustion engine (the fourth term of numerator on the right side of equation (15)), the cylinder pressure of the burning cylinder (the left side of the equation (15)) is estimated.

SUMMARY

However, in the crank angle, the detection error due to the manufacture error of the tooth of the signal plate, the aging change, and the like is included. And, in the crank angle acceleration calculated based on the crank angle, the error component of high frequency is included. In the technology of JP 6029726 B, two parameters of the shaft torque and the reciprocation inertia torque are calculated based on the crank angle acceleration. Therefore, in the case where the error component of high frequency is superimposed on the crank angle acceleration, there was a problem that the estimation accuracy of the cylinder internal pressure of the burning cylinder is deteriorated easily, and the estimation accuracy of the combustion state is deteriorated easily. There was a problem that the estimation accuracy of the combustion state is deteriorated due to modeling errors, such as influence of the balance weight of the crankshaft and deviation of the center of gravity which cannot be expressed by the equation (15) of JP 6029726 B.

In the technology of JP 6029726 B, it is necessary to calculate individually the cylinder internal pressure of plural unburning cylinders, and calculate individually the reciprocation inertia torque of the piston of the plurality of cylinders. Accordingly, arithmetic load increases, and it is necessary to set constants, such as mass of the piston.

Then, the purpose of the present disclosure is to provide a controller and a control method for internal combustion engine which can reduce arithmetic load, while suppressing deterioration in the estimation accuracy of the parameter relevant to the combustion state, even if the error component of high frequency is included in the crank angle acceleration and the modeling of the crank mechanism is not easy.

A controller for internal combustion engine according to the present disclosure including:

an angle information detection unit that detects a crank angle and a crank angle acceleration, based on an output signal of a crank angle sensor;

an actual shaft torque calculation unit that calculates an actual shaft torque applied to a crankshaft, based on the crank angle acceleration and an inertia moment of a crankshaft system; and a gas pressure torque calculation unit that, in a burning condition of an internal combustion engine, by referring an unburning condition data in which a relationship between the crank angle and a shaft torque in unburning is set, calculates the shaft torque in unburning corresponding to a crank angle in a vicinity of a top dead center of a combustion stroke;

calculates an external load torque which is a torque applied to the crankshaft from an outside of the internal combustion engine, based on the calculated shaft torque in unburning in the vicinity of the top dead center, and the actual shaft torque in burning calculated by the actual shaft torque calculation unit at the crank angle in the vicinity of the top dead center;

by referring the unburning condition data, calculates the shaft torque in unburning corresponding to a crank angle of an arithmetic object; and calculates an increment of gas pressure torque by burning which is included in a gas pressure torque applied to the crankshaft by a gas pressure in cylinder, at the crank angle of the arithmetic object, based on the calculated shaft torque in unburning at the crank angle of the arithmetic object, the actual shaft torque in burning corresponding to the crank angle of the arithmetic object, and the calculated external load torque.

A control method for internal combustion engine according to the present disclosure includes:

an angle information detection step that detects a crank angle and a crank angle acceleration, based on an output signal of a crank angle sensor;

an actual shaft torque calculation step that calculates an actual shaft torque applied to a crankshaft, based on the crank angle acceleration and an inertia moment of a crankshaft system; and a gas pressure torque calculation step that, in a burning condition of an internal combustion engine, by referring an unburning condition data in which a relationship between the crank angle and a shaft torque in unburning is set, calculates the shaft torque in unburning corresponding to a crank angle in a vicinity of a top dead center of a combustion stroke;

calculates an external load torque which is a torque applied to the crankshaft from an outside of the internal combustion engine, based on the calculated shaft torque in unburning in the vicinity of the top dead center, and the actual shaft torque in burning calculated in the actual shaft torque calculation step at the crank angle in the vicinity of the top dead center;

by referring the unburning condition data, calculates the shaft torque in unburning corresponding to a crank angle of an arithmetic object; and calculates an increment of gas pressure torque by burning which is included in a gas pressure torque applied to the crankshaft by a gas pressure in cylinder, at the crank angle of the arithmetic object, based on the calculated shaft torque in unburning at the crank angle of the arithmetic object, the actual shaft torque in burning corresponding to the crank angle of the arithmetic object, and the calculated external load torque.

According to the controller and the control method for internal combustion engine concerning the present disclosure, by referring the unburning condition data in which the relationship between the crank angle and the shaft torque in unburning is set, the shaft torque in unburning is calculated. The shaft torque in unburning includes the gas pressure torque by the cylinder pressures of all cylinders in the case of unburning condition, and the reciprocation inertia torque of the pistons of all cylinders. Therefore, it is not necessary to calculate the reciprocation inertia torque by the crank angle acceleration, using the equation of motion around the crankshaft like the equation (15) of JP 6029726 B. Even if the error component of high frequency is superimposed on the crank angle acceleration, the estimation accuracy of the parameter relevant to the combustion state can be suppressed from deteriorating. Since the equation of motion around the crankshaft like the equation (15) of JP 6029726 B is not used, the estimation accuracy of the parameter relevant to the combustion state due to the modeling error can be suppressed from deteriorating. Since it is not necessary to calculate individually the cylinder pressures of plural unburning cylinders and it is not necessary to calculate individually the reciprocation inertia torques of the pistons of plural cylinders like JP 6029726 B, the increase in arithmetic load can be suppressed.

Since the gas pressure torque of the burning cylinder becomes about 0 in the vicinity of the top dead center of the combustion stroke, the external load torque can be calculated with small arithmetic load, based on the shaft torque in unburning in the vicinity of the top dead center calculated with reference to the unburning condition data, and the actual shaft torque in burning in the vicinity of the top dead center. Then, as the parameter relevant to the combustion state, the increment of gas pressure torque by burning can be calculated with small arithmetic load, based on the shaft torque in unburning calculated with reference to the unburning condition data, the actual shaft torque in burning, and the external load torque. Accordingly, even if the error component of high frequency is included in the crank angle acceleration and the modeling of the crank mechanism is not easy, the arithmetic load can be reduced while suppressing deterioration in the estimation accuracy of the parameter relevant to the combustion state.

DETAILED DESCRIPTION OF THE EMBODIMENTS

1. Embodiment 1

Figure 1:
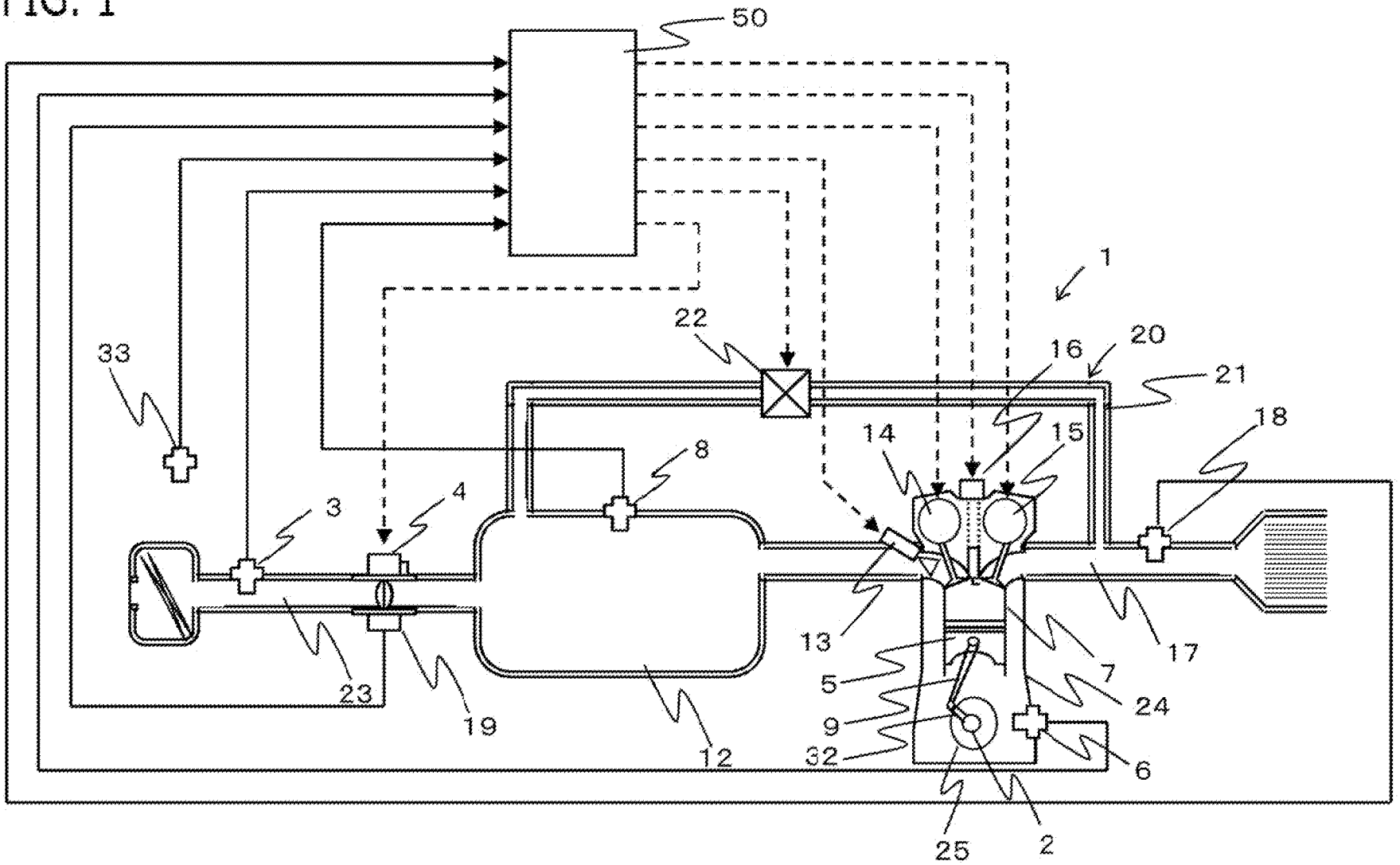
FIG. 1 is a schematic configuration diagram of the internal combustion engine and the controller according to Embodiment 1.
Figure 2:
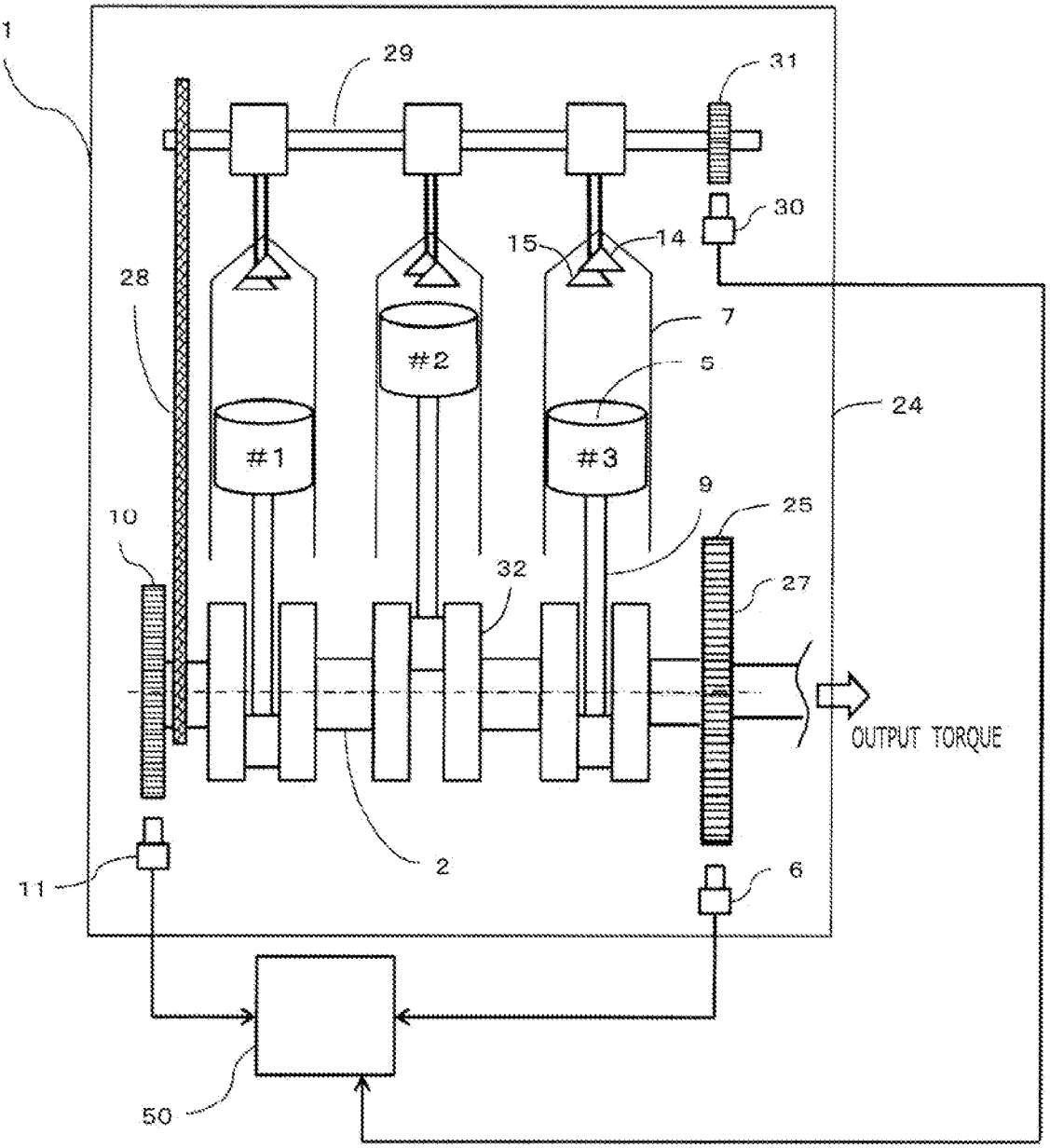
FIG. 2 is a schematic configuration diagram of the internal combustion engine and the controller according to Embodiment 1.
Figure 3:
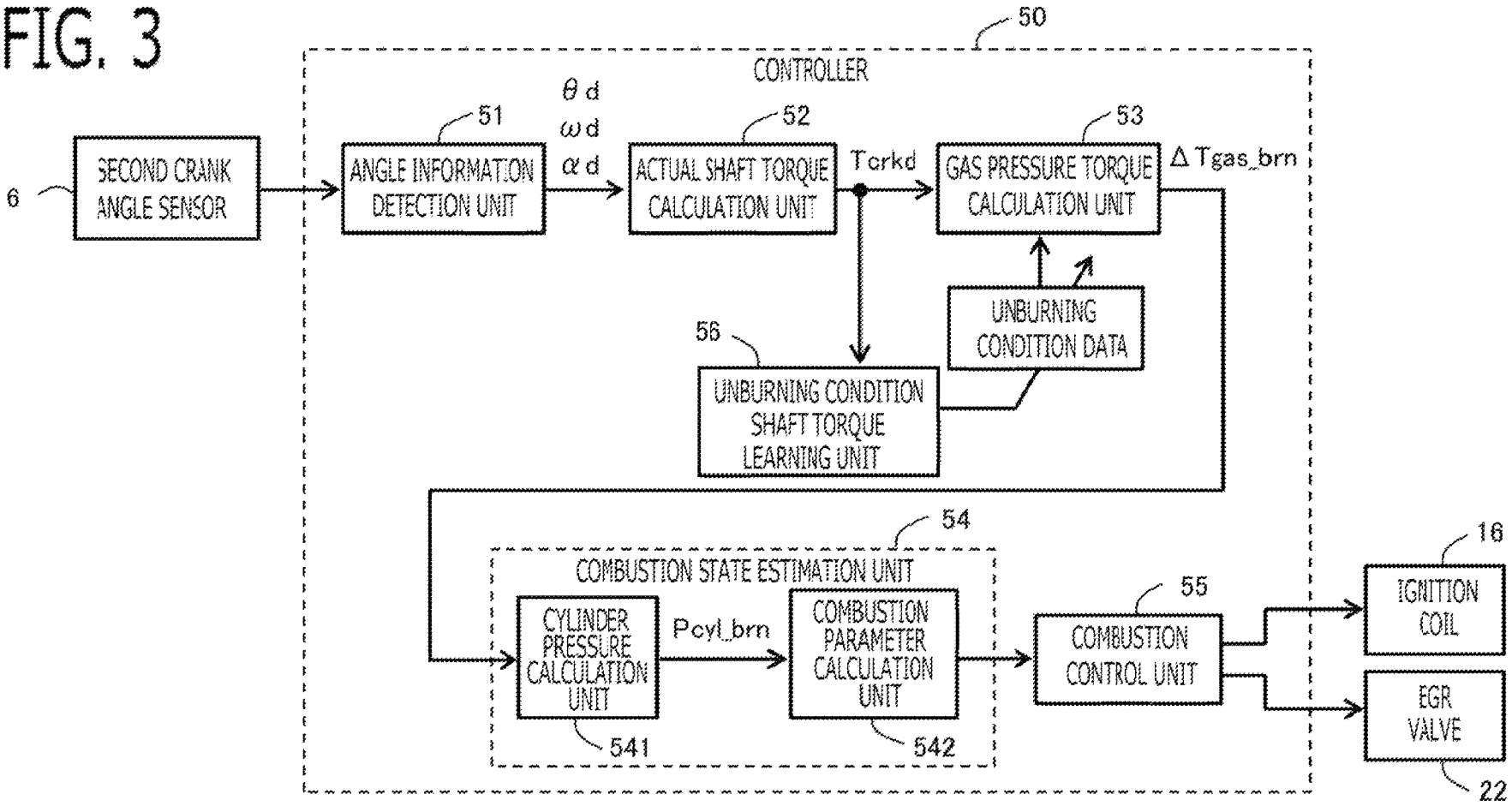
FIG. 3 is a block diagram of the controller according to Embodiment 1.

A controller 50 for internal combustion engine (hereinafter, referred to simply as the controller 50) according to Embodiment 1 will be explained with reference to the drawings. FIG. 1 and FIG. 2 are a schematic configuration diagram of the internal combustion engine 1 and the controller 50. FIG. 3 is a block diagram of the controller 50 according to Embodiment 1. The internal combustion engine 1 and the controller 50 are mounted in a vehicle, and the internal combustion engine 1 functions as a driving-force source for the vehicle (wheels).

1-1. Configuration of Internal Combustion Engine 1

The configuration of the internal combustion engine 1 will be explained. As shown in FIG. 1, the internal combustion engine 1 is provided with cylinders 7 in which a fuel-air mixture is combusted. The internal combustion engine 1 is provided with an intake path 23 for supplying air to the cylinders 7 and an exhaust path 17 for discharging exhaust gas from the cylinders 7. The internal combustion engine 1 is a gasoline engine. The internal combustion engine 1 is provided with a throttle valve 4 which opens and closes the intake path 23. The throttle valve 4 is an electronically controlled throttle valve which is opening/closing-driven by an electric motor controlled by controller 50. A throttle position sensor 19 which outputs an electric signal according to the opening degree of the throttle valve 4 is provided in the throttle valve 4.

An air flow sensor 3 which outputs an electric signal according to an intake air amount taken into the intake path 23 is provided in the intake path 23 on the upstream side of throttle valve 4. The internal combustion engine 1 is provided with an exhaust gas recirculation apparatus 20. The exhaust gas recirculation apparatus 20 has an EGR passage 21 which recirculates the exhaust gas from the exhaust path 17 to the intake manifold 12, and an EGR valve 22 which opens and closes the EGR passage 21. The intake manifold 12 is a part of the intake path 23 on the downstream side of the throttle valve 4. The EGR valve 22 is an electronic controlled EGR valve which is opening/closing-driven by an electric motor controlled by controller 50. An air-fuel ratio sensor 18 which outputs an electric signal according to an air-fuel ratio of exhaust gas in the exhaust path 17 is provided in the exhaust path 17.

A manifold pressure sensor 8 which outputs an electric signal according to a pressure in the intake manifold 12 is provided in the intake manifold 12. An injector 13 for injecting a fuel is provided on the downstream side part of the intake manifold 12. The injector 13 may be provided so as to inject a fuel directly into the cylinder 7. An atmospheric pressure sensor 33 which outputs an electric signal according to an atmospheric pressure is provided in the internal combustion engine 1.

An ignition plug for igniting a fuel-air mixture and an ignition coil 16 for supplying ignition energy to the ignition plug are provided on the top of the cylinder 7. An intake valve 14 for adjusting the amount of intake air to be taken from the intake path 23 into the cylinder 7 and an exhaust valve 15 for adjusting the amount of exhaust gas to be exhausted from the cylinder to the exhaust path 17 are provided on the top of the cylinder 7. The intake valve 14 is provided with an intake variable valve timing mechanism which makes the opening and closing timing thereof variable. The exhaust valve 15 is provided with an exhaust variable valve timing mechanism which makes the opening and closing timing thereof variable. Each of the variable valve timing mechanisms 14, 15 has an electric actuator.

As shown in FIG. 2, the internal combustion engine 1 has a plurality of cylinders 7 (in this example, three). A piston 5 is provided inside of the each cylinder 7. The piston 5 of each cylinder 7 is connected to a crankshaft 2 via a connecting rod 9 and a crank 32. The crankshaft 2 is rotated by reciprocating movement of the piston 5. A combustion gas pressure generated in each cylinder 7 presses the top face of the piston 5, and rotates the crankshaft 2 via the connecting rod 9 and the crank 32. The crankshaft 2 is connected with a power transfer mechanism which transmits driving force to the wheels. The power transfer mechanism is provided with a gearbox, a differential gear, and the like. The vehicle provided with the internal combustion engine 1 may be a hybrid vehicle provided with a motor generator in the power transfer mechanism.

The internal combustion engine 1 is provided with a signal plate 10 which rotates integrally with the crankshaft 2. A plurality of teeth are provided in the signal plate 10 at a plurality of preliminarily set crank angles. In the present embodiment, the teeth of the signal plate 10 are arranged at intervals of 10 degrees. The teeth of the signal plate 10 are provided with a chipped tooth part in which a part of teeth is chipped. The internal combustion engine 1 is provided with a first crank angle sensor 11 which is fixed to an engine block 24 and detects the tooth of the signal plate 10.

The internal combustion engine 1 is provided with a cam shaft 29 connected with crankshaft 2 via a chain 28. The cam shaft 29 carries out the opening-and-closing drive of the intake valve 14 and the exhaust valve 15. During the crankshaft 2 rotates two times, the cam shaft 29 rotates once. The internal combustion engine 1 is provided with a signal plate 31 for cam which rotates integrally with the cam shaft 29. A plurality of teeth are provided in the signal plate 31 for cam at a plurality of preliminarily set cam shaft angles. The internal combustion engine 1 is provided with a cam angle sensor 30 which is fixed to an engine block 24 and detects the tooth of signal plate 31 for cam.

Based on two kinds of output signals of the first crank angle sensor 11 and the cam angle sensor 30, the controller 50 detects the crank angle on the basis of the top dead center of each piston 5 and determines the stroke of each cylinder 7. The internal combustion engine 1 is a 4-stroke engine which has an intake stroke, a compression stroke, a combustion stroke, and an exhaust stroke.

The internal combustion engine 1 is provided with a flywheel 27 which rotates integrally with the crankshaft 2. The peripheral part of flywheel 27 is a ring gear 25, and a plurality of teeth are provided in the ring gear 25 at a plurality of preliminarily set crank angles. The teeth of the ring gear 25 are arranged in the peripheral direction with equiangular intervals. In this example, 90 teeth are provided with intervals of 4 degrees. The teeth of ring gear 25 are not provided with a chipped tooth part. The internal combustion engine 1 is provided with a second crank angle sensor 6 which is fixed to the engine block 24 and detects the tooth of the ring gear 25. The second crank angle sensor 6 is disposed oppositely to the ring gear 25 with a space in radial-direction outside of the ring gear 25. The opposite side of the flywheel 27 to the crankshaft 2 is connected with a power transfer mechanism. Accordingly, the output torque of the internal combustion engine 1 passes through a part of the flywheel 27, and is transmitted to the wheels side.

Each of the first crank angle sensor 11, the cam angle sensor 30, and the second crank angle sensor 6 outputs an electric signal according to change of the distance between each sensor and tooth by rotation of the crankshaft 2. The output signal of each angle sensor 11, 30, 6 becomes a rectangular wave that a signal turns on or off when the distance between sensor and tooth is near or when the distance is far. An electromagnetic pickup type sensor is used for each angle sensor 11, 30, 6, for example.

Since the flywheel 27 (the ring gear 25) has larger number of teeth than the number of teeth of the signal plate 10, and there is also no chipped tooth part, a high resolution angle detection can be expected. Since the flywheel 27 has larger mass than the mass of the signal plate 10 and high frequency oscillation is suppressed, a high accuracy of angle detection can be expected.

1-2. Configuration of Controller 50

Figure 4:
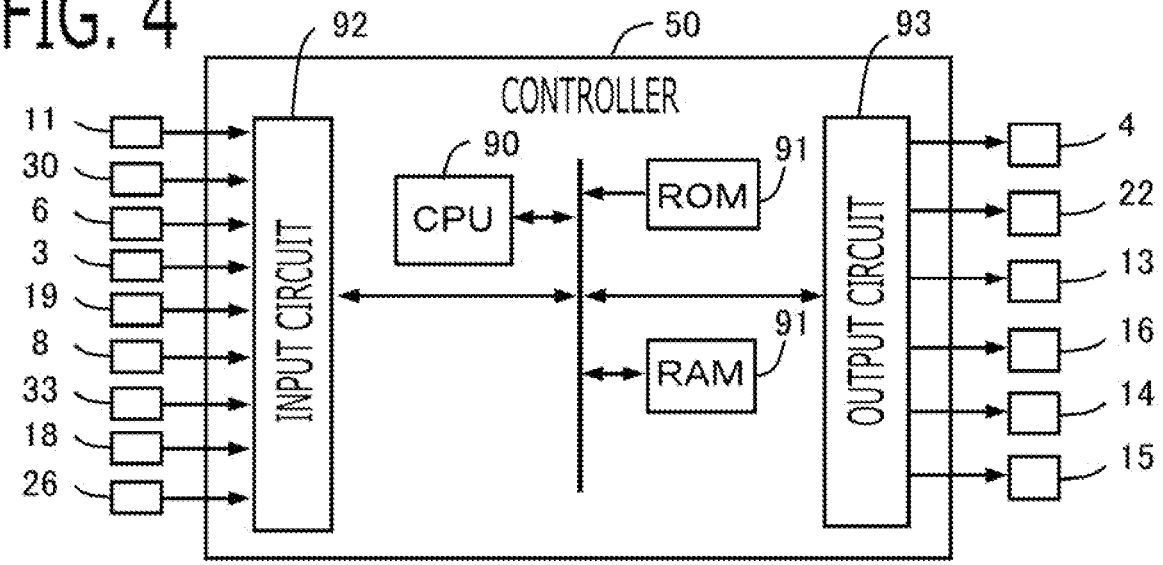
FIG. 4 is a hardware configuration diagram of the controller according to Embodiment 1.

Next, the controller 50 will be explained. The controller 50 is the one whose control object is the internal combustion engine 1. As shown in FIG. 3, the controller 50 is provided with control units such as an angle information detection unit 51, an actual shaft torque calculation unit 52, a gas pressure torque calculation unit 53, a combustion state estimation unit 54, a combustion control unit 55, and an unburning condition shaft torque learning unit 56. The respective control units 51 to 56 of the controller 50 are realized by processing circuits included in the controller 50. Specifically, as shown in FIG. 4, the controller 50 includes, as a processing circuit, an arithmetic processor (computer) 90 such as a CPU (Central Processing Unit), storage apparatuses 91 which exchange data with the arithmetic processor 90, an input circuit 92 which inputs external signals to the arithmetic processor 90, an output circuit 93 which outputs signals from the arithmetic processor 90 to the outside, and the like.

As the arithmetic processor 90, ASIC (Application Specific Integrated Circuit), IC (Integrated Circuit), DSP (Digital Signal Processor), FPGA (Field Programmable Gate Array), various kinds of logical circuits, various kinds of signal processing circuits, and the like may be provided. As the arithmetic processor 90, a plurality of the same type ones or the different type ones may be provided, and each processing may be shared and executed.

As the storage apparatus 91, volatile and nonvolatile storage apparatuses, such as RAM (Random Access Memory), ROM (Read Only Memory), and EEPROM (Electrically Erasable Programmable ROM), are provided.

The input circuit 92 is connected with various kinds of sensors and switches and is provided with an A/D converter and the like for inputting output signals from the sensors and the switches to the arithmetic processor 90. The output circuit 93 is connected with electric loads and is provided with a driving circuit and the like for outputting a control signal from the arithmetic processor 90.

In addition, the computing processing unit 90 runs software items (programs) stored in the storage apparatus 91 such as ROM and EEPROM, and collaborates with other hardware devices in the controller 50, such as the storage apparatus 91, the input circuit 92, and the output circuit 93, so that the respective functions of the control units 51 to 56 included in the controller 50 are realized. Setting data items such as an unburning condition data, an inertia moment Icrk, and a filter coefficient bj to be used in the control units 51 to 56 are stored, as part of software items (programs), in the storage apparatus 91 such as ROM and EEPROM. Each calculation value and each detection value, such as a crank angle θd, a crank angle speed ωd, a crank angle acceleration αd, an actual shaft torque Tcrkd, an increment of gas pressure torque by burning ΔTgas_brn, and a cylinder pressure in burning Pcyl_brn, which are calculated by each control unit 51 to 56, are stored in the storage apparatus 91, such as RAM.

In the present embodiment, the input circuit 92 is connected with the first crank angle sensor 11, the cam angle sensor 30, the second crank angle sensor 6, the air flow sensor 3, the throttle position sensor 19, the manifold pressure sensor 8, the atmospheric pressure sensor 33, the air fuel ratio sensor 18, an accelerator position sensor 26, and the like. The output circuit 93 is connected with the throttle valve 4 (electric motor), the EGR valve 22 (electric motor), the injector 13, the ignition coil 16, the intake-air variable valve timing mechanism 14, the exhaust-gas variable valve timing mechanism 15, and the like. The controller 50 is connected with various kinds of unillustrated sensors, switches, actuators, and the like. The controller 50 detects driving conditions of the internal combustion engine 1, such as an intake air amount, a pressure in the intake manifold, an atmospheric pressure, an air-fuel ratio, and an accelerator opening degree, based on the output signals of various sensors.

As basic control, the controller 50 calculates a fuel injection amount, an ignition timing, and the like, based on inputted output signals and the like from the various kinds of sensors, and then performs driving control of the injector 13, the ignition coil 16, and the like. Based on the output signal of the accelerator position sensor 26 and the like, the controller 50 calculates an output torque of the internal combustion engine 1 demanded by the driver, and then controls the throttle valve 4 and the like so that an intake air amount for realizing the demanded output torque is obtained. Specifically, the controller 50 calculates a target throttle opening degree and then performs driving control of the electric motor of the throttle valve 4 so that the throttle opening degree which is detected based on the output signal of the throttle position sensor 19 approaches the target throttle opening degree. And, the controller 50 calculates a target opening degree of the EGR valve 22 based on inputted output signals and the like from the various kinds of sensors and then performs driving control of the electric motor of the EGR valve 22. The controller 50 calculates a target opening and closing timing of the intake valve and a target opening and closing timing of the exhaust valve based on the output signals of the various sensors, and performs driving control of the intake and exhaust variable valve timing mechanisms 14, 15 based on each target opening and closing timing.

1-2-1. Angle Information Detection Unit 51

The angle information detection unit 51 detects a crank angle θd, a crank angle speed ωd which is a time change rate of the crank angle θd, and a crank angle acceleration αd which is a time change rate of the crank angle speed ωd, based on the output signal of the second crank angle sensor 6.

Figure 5:
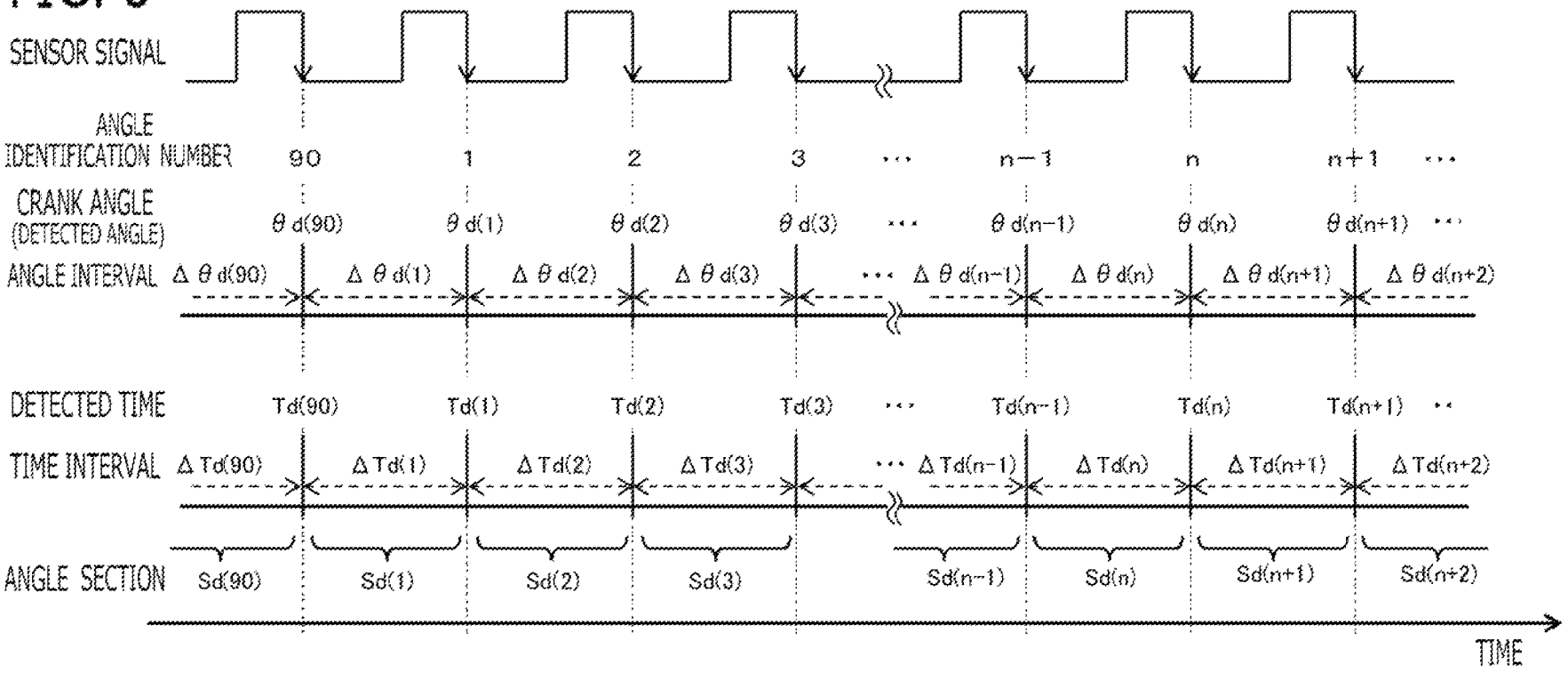
FIG. 5 is a time chart for explaining an angle information detection processing according to Embodiment 1.

In the present embodiment, as shown in FIG. 5, the angle information detection unit 51 detects the crank angle θd based on the output signal of the second crank angle sensor 6 and detects a detected time Td at which the crank angle θd is detected. Then, based on a detected angle θd which is the detected crank angle θd, and the detected time Td, the angle information detection unit 51 calculates an angle interval Δθd and a time interval ΔTd corresponding to an angle section Sd between the detected angles θd.

In the present embodiment, the angle information detection unit 51 determines the crank angle θd when a falling edge (or rising edge) of the output signal (rectangular wave) of the second crank angle sensor 6 is detected. The angle information detection unit 51 determines a basing point falling edge which is a falling edge corresponding to a basing point angle (for example, 0 degree which is a top dead center of the piston 5 of the first cylinder #1), and determines the crank angle θd corresponding to a number n of the falling edge which is counted up on the basis of the basing point falling edge (hereinafter, referred to as an angle identification number n). For example, when the basing point falling edge is detected, the angle information detection unit 51 sets the crank angle θd to the basing point angle (for example, 0 degree), and sets the angle identification number n to 0. Then, every time the falling edge is detected, the angle information detection unit 51 increases the crank angle θd by a preliminarily set angle interval Δθd (in this example, 4 degrees) and increases the angle identification number n by one. Alternatively, the angle information detection unit 51 may read out the crank angle θd corresponding to the this time identification number n, by use of an angle table in which a relationship between the angle identification number n and the crank angle θd is preliminarily set. The angle information detection unit 51 correlates the crank angle θd (the detected angle θd) with the angle identification number n. The angle identification number n returns to 1 after a maximum number (in this example, 90). The last time angle identification number n of the angle identification number n=1 is 90, and the next time angle identification number n of the angle identification number n=90 is 1.

In the present embodiment, as described later, the angle information detection unit 51 determines the basing point falling edge of the second crank angle sensor 6 with reference to a reference crank angle detected based on the first crank angle sensor 11 and the cam angle sensor 30. For example, the angle information detection unit 51 determines the falling edge at which the reference crank angle when the falling edge of the second crank angle sensor 6 is detected becomes the closest to the basing point angle, as the basing point falling edge.

The angle information detection unit 51 determines the stroke of each cylinder 7 corresponding to the crank angle θd with reference to the stroke of each cylinder 7 determined based on the first crank angle sensor 11 and the cam angle sensor 30.

The angle information detection unit 51 detects a detected time Td when the falling edge of the output signal (rectangular wave) of the second crank angle sensor 6 is detected, and correlates the detected time Td with the angle identification number n. Specifically, the angle information detection unit 51 detects the detected time Td using the timer function provided in the arithmetic processor 90.

As shown in FIG. 5, when the falling edge is detected, the angle information detection unit 51 sets the angle section between the detected angle θd(n) corresponding to the this time angle identification number (n) and the detected angle θd(n−1) corresponding to the last time angle identification number (n−1), as the angle section Sd(n) corresponding to the this time angle identification number (n).

As shown in an equation (1), when the falling edge is detected, the angle information detection unit 51 calculates a deviation between the detected angle θd(n) corresponding to the this time angle identification number (n) and the detected angle θd(n−1) corresponding to the last time angle identification number (n−1), and sets the calculated deviation as the angle interval Δθd(n) corresponding to the this time angle identification number (n) (the this time angle section Sd(n)).

$$\Delta\theta d(n)=\theta d(n)-\theta d(n-1) \tag{1}$$

In the present embodiment, since all the angle intervals of the tooth of ring gear 25 are made equal, the angle information detection unit 51 sets the angle interval Δθd of all the angle identification numbers n as a preliminarily set angle (in this example, 4 degrees).

As shown in an equation (2), when the falling edge is detected, the angle information detection unit 51 calculates a deviation between the detected time Td(n) corresponding to the this time angle identification number (n) and the detected time Td(n−1) corresponding to the last time angle identification number (n−1), and sets the calculated deviation as the time interval ΔTd(n) corresponding to the this time angle identification number (n) (the this time angle section Sd(n)).

$$\Delta Td(n)=Td(n)-Td(n-1) \tag{2}$$

Based on two kinds of output signals of the first crank angle sensor 11 and the cam angle sensor 30, the angle information detection unit 51 detects the reference crank angle on the basis of the top dead center of the piston 5 of the first cylinder #1, and determines the stroke of each cylinder 7. For example, the angle information detection unit 51 determines the falling edge just after the chipped tooth part of the signal plate 10 based on the time interval of the falling edge of the output signal (rectangular wave) of the first crank angle sensor 11. Then, the angle information detection unit 51 determines a correspondency between the each falling edge on the basis of the falling edge just after the chipped tooth part, and the reference crank angle on the basis of the top dead center, and calculates the reference crank angle on the basis of the top dead center when each falling edge is detected. The angle information detection unit 51 determines the stroke of each cylinder 7 based on the relationship between the position of the chipped tooth part in the output signal (rectangular wave) of the first crank angle sensor 11, and the output signal (rectangular wave) of the cam angle sensor 30.

<Filter Processing>

Figure 6:
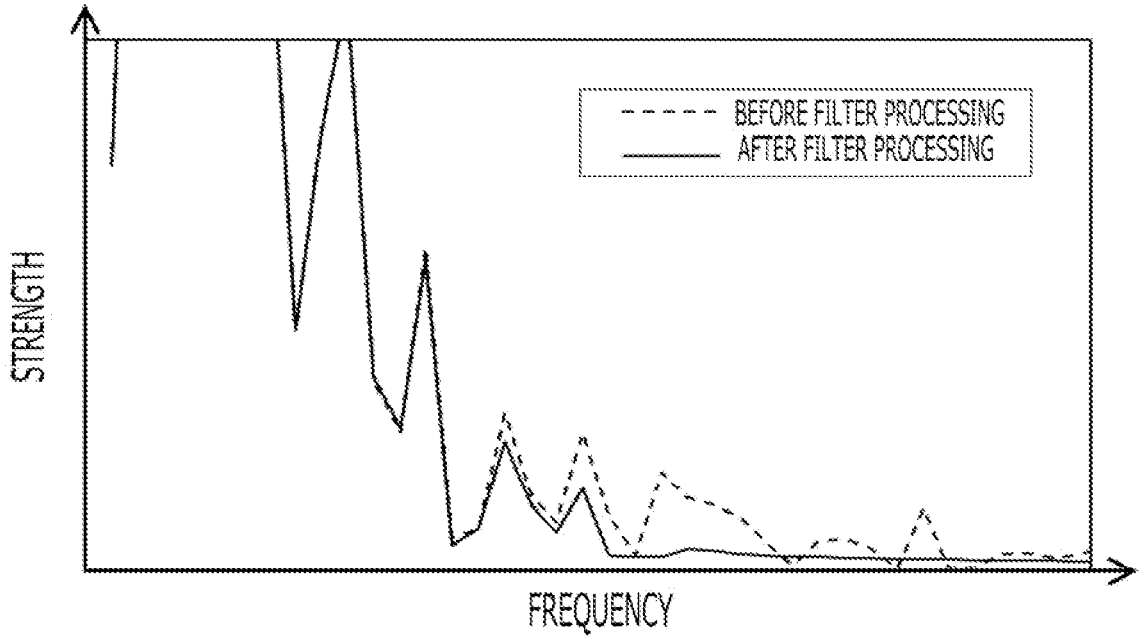
FIG. 6 is a figure showing a frequency spectrum of the crank angle periods before and after filter according to Embodiment 1.

The angle information detection unit 51 performs a filter processing which removes a high frequency error component, when calculating the crank angle acceleration αd. The angle information detection unit 51 performs the filter processing to the time interval ΔTd. The time interval ΔTd is a crank angle period ΔTd which is a period of a unit angle (in this example, 4 degrees). As the filter processing, for example, a finite impulse response (FIR) filter is used. As FIG. 6 shows a frequency spectrum of the time interval (the crank angle period) before and after filter, the high frequency component caused by the production variation of teeth and the like is reduced by the filter processing. As described later, even if the high frequency component of the increment of gas pressure torque by burning ΔTgas_brn cannot be removed by subtracting the shaft torque in unburning Tcrk_mot from the actual shaft torque in burning Tcrkd_brn calculated based on the crank angle acceleration αd, the high frequency component of the increment of gas pressure torque by burning ΔTgas_brn can be reduced by reducing the high frequency component of the crank angle acceleration ad by the filter processing.

For example, as the FIR filter, the processing shown in the equation (3) is performed.

$$\Delta Tdf(n)=\sum_{j=0}^{N} b_j \Delta Td(n-j) \tag{3}$$

Herein, ΔTdf(n) is a time interval (a crank angle period) after filter, N is an order of the filter, and bj is a coefficient of the filter.

The angle information detection unit 51 performs the filter processing with the same filter characteristics between the unburning condition and the burning condition. In this example, the order N of the filter and the each coefficient bj of the filter are set to the same values between the unburning condition and the burning condition. According to this configuration, when the unburning condition data are updated by the actual shaft torque in unburning described below, the removal state of the high frequency error component of the actual shaft torque in unburning and the removal state of the high frequency error component of the actual shaft torque in burning can be coincided. Accordingly, when calculating the increment of gas pressure torque by burning ΔTgas_brn, by subtracting the shaft torque in unburning Tcrk_mot from the actual shaft torque in burning Tcrkd_brn, the high frequency error component which is not removed sufficiently can be canceled, and the calculation accuracy of the increment of gas pressure torque by burning ΔTgas_brn can be suppressed from deteriorating by the high frequency error component.

The filter processing which removes the high frequency error component may be performed to the crank angle speed ωd(n) described below, instead of the time interval ΔTd. Alternatively, the filter processing may not be performed when calculating the crank angle acceleration αd.

Instead of the filter processing or with the filter processing, the angle information detection unit 51 may correct the time interval ΔTd(n) of each angle identification number n by a correction coefficient Kc(n) which is set corresponding to each angle identification number n. The correction coefficients Kc(n) are learned based on the time intervals ΔTd(n) using the method disclosed in JP 6169214 B and the like, or are preliminarily set by matching in production.

<Calculation of Crank Angle Speed ωd and Crank Angle Acceleration αd>

Based on the angle interval Δθd and the time interval after filter ΔTdf, the angle information detection unit 51 calculates a crank angle speed ωd which is a time change rate of the crank angle θd, and a crank angle acceleration αd which is a time change rate of the crank angle speed ωd, corresponding to each of the detected angle θd or the angle interval Sd.

Figure 7:
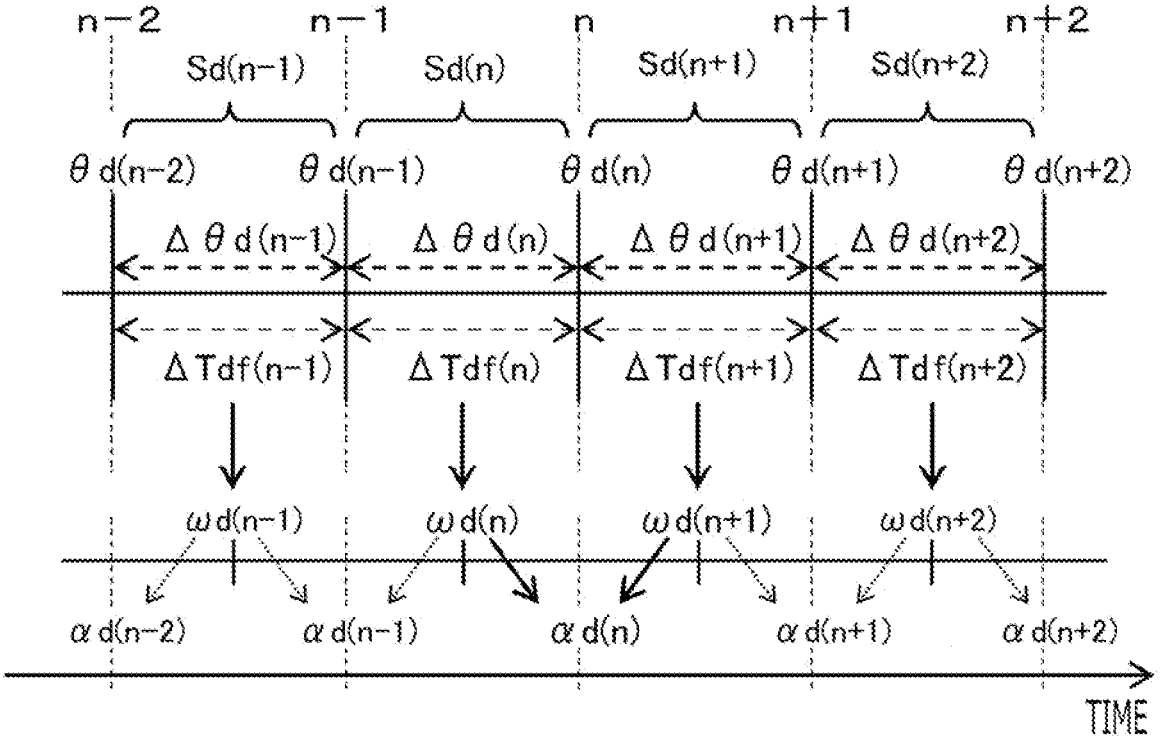
FIG. 7 is a time chart for explaining an angle information calculation processing according to Embodiment 1.

In the present embodiment, as shown in FIG. 7, based on the angle interval Δθd(n) and the time interval ΔTdf(n) corresponding to the angle interval Sd(n) set to the processing object, the angle information detection unit 51 calculates the crank angle speed ωd(n) corresponding to the angle interval Sd(n) of the processing object. Specifically, as shown in the equation (4), the angle information detection unit 51 calculates the crank angle speed ωd(n) by dividing the angle interval Δθd(n) corresponding to the angle interval Sd(n) of the processing object by the time interval after filter ΔTdf(n).

$$\omega d(n) = \frac{\Delta\theta d(n)}{\Delta Tdf(n)} \times \frac{\pi}{180} \tag{4}$$

Based on the crank angle speed ωd(n) and the time interval after filter ΔTdf(n) corresponding to the just before one angle interval Sd(n) of the detected angle θd(n) set to the processing object, and the crank angle speed ωd(n+1) and the time interval after filter ΔTdf(n+1) corresponding to the just after one angle interval Sd(n+1) of the detected angle θd(n) set to the processing object, the angle information detection unit 51 calculates the crank angle acceleration αd(n) corresponding to the detected angle θd(n) of the processing object. Specifically, as shown in the equation (5), the angle information detection unit 51 calculates the crank angle acceleration αd(n) by dividing a subtraction value obtained by subtracting the just before crank angle speed ωd(n) from the just after crank angle speed ωd(n+1), by an average value of the just after time interval after filter ΔTdf(n+1) and the just before time interval after filter ΔTdf(n).

$$\alpha d(n) = \frac{\omega d(n+1) - \omega d(n)}{\Delta Tdf(n+1) + \Delta Tdf(n)} \times 2 \tag{5}$$

The angle information detection unit 51 stores angle information, such as the angle identification number n, the crank angle θd(n), the time interval before filter ΔTd(n), the time interval after filter ΔTdf(n), the crank angle speed ωd(n), and the crank angle acceleration αd(n), to the storage apparatus 91 such as RAM, during a period at least longer than the combustion stroke.

1-2-2. Actual Shaft Torque Calculation Unit 52

The actual shaft torque calculation unit 52 calculates an actual shaft torque Tcrkd applied to the crankshaft, based on the crank angle acceleration ad and an inertia moment Icrk of a crankshaft system.

In the present embodiment, as shown in the next equation, the actual shaft torque calculation unit 52 calculates the actual shaft torque Tcrkd(n) by multiplying the inertia moment Icrk of the crankshaft system to the crank angle acceleration αd(n) at each crank angle θd(n).

$$Tcrkd(n) = \alpha d(n) \times Icrk \tag{6}$$

The inertia moment Icrk of the crankshaft system is an inertia moment of the whole member which rotates integrally with the crankshaft 2 (for example, the crankshaft 2, the crank 32, the flywheel 27, and the like), and is preliminarily set.

The actual shaft torque calculation unit 52 stores the calculated actual shaft torque Tcrkd(n) to the storage apparatus 91 such as RAM, together with angle information such as corresponding the angle identification number n and the crank angle θd(n), during a period at least longer than the combustion stroke.

1-2-3. Gas Pressure Torque Calculation Unit 53

1-2-3-1. Calculation of External Load Torque in Burning

<Calculation Principle of External Load Torque>

Figures 8, 9:
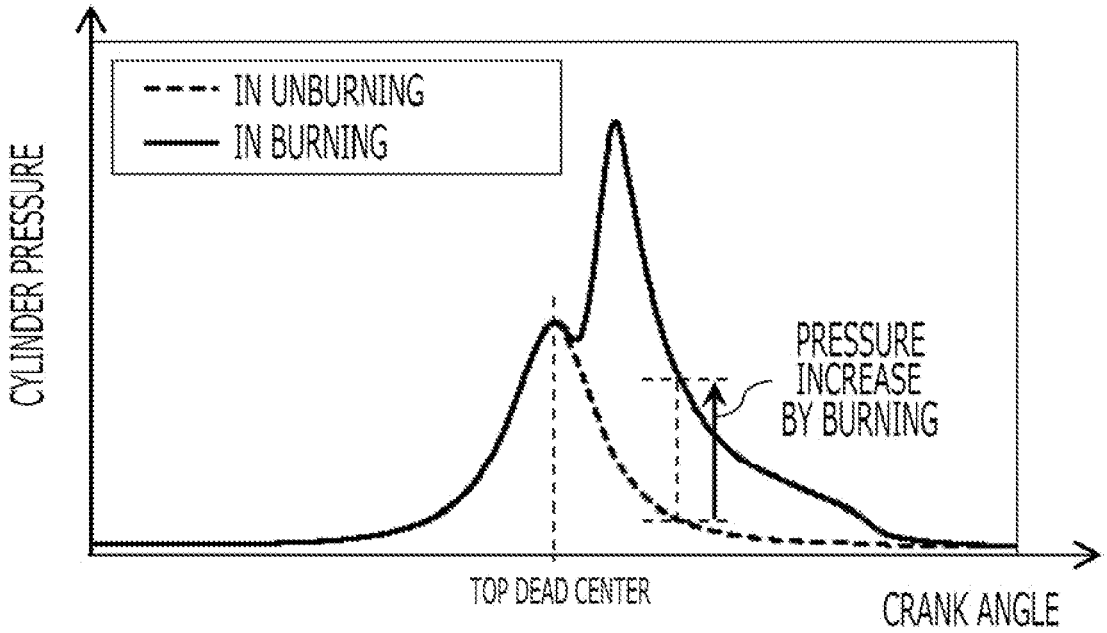
FIG. 8 is a figure for explaining the cylinder pressure in unburning and the cylinder pressure in burning according to Embodiment 1.
FIG. 9 is a figure for explaining the unburning condition data according to Embodiment 1.

As shown in FIG. 8, the cylinder pressure in burning increases by a pressure increment by burning more than the cylinder pressure in unburning. As shown in the next equation, the shaft torque in burning Tcrk_brn increases by an increment of shaft torque ΔTgas_brn generated by this pressure increment by burning more than the shaft torque in unburning Tcrk_mot. Since this increment of shaft torque ΔTgas_brn is an increment of gas pressure torque generated by the gas pressure increase which is an increase from the cylinder pressure in unburning (the gas pressure) to the cylinder pressure in burning (the gas pressure), it is referred to as an increment of gas pressure torque by burning ΔTgas_brn. The shaft torque in unburning Tcrk_mot includes a gas pressure torque which is a torque applied to the crankshaft by a force of the gas pressure in each cylinder in unburning pushing the piston, and a reciprocation inertia torque which is a torque applied to the crankshaft by a reciprocation inertia of the piston of each cylinder. As described later, since the shaft torque in unburning Tcrk_mot does not include an external load torque in burning Tload_brn, as shown in the next equation, it is necessary to subtract the external load torque in burning Tload_brn. The external load torque Tload is a torque applied to the crankshaft from the outside of the internal combustion engine. The external load torque Tload includes a running resistance and a frictional resistance of the vehicle which are transmitted to the internal combustion engine from the power transfer mechanism connected with the wheels, and an auxiliary machine load, such as the alternator connected with the crankshaft.

$$Tcrk_brn = Tcrk_mot + \Delta Tgas_brn - Tload_brn \tag{7}$$

In the vicinity of the top dead center, the connecting rod and the crank become in a straight line, and the shaft torque Tcrk is not generated by the force of the cylinder pressure pushing the piston. Accordingly, in the vicinity of the top dead center of the compression stroke, the increment of shaft torque by burning ΔTgas_brn becomes 0. Therefore, as shown in the next equation obtained by modifying the equation (7), by subtracting the actual shaft torque in this time burning Tcrkd_brn_tdc in the vicinity of the top dead center from the shaft torque in unburning Tcrk_mot_tdc in the vicinity of the top dead center, the external load torque in this time burning Tload_brn can be calculated.

$$\Delta Tgas_brn_tdc = 0$$

$$Tload_brn = Tcrk_mot_tdc - Tcrkd_brn_tdc \tag{8}$$

Since the external load torque Tload does not fluctuate largely in the stroke period, the external load torque Tload calculated in the vicinity of the top dead center can be used at each crank angle Δd of the combustion stroke.

In the present disclosure, "burning condition" and "in burning" are a condition and a time that the controller 50 controls so as to burn fuel in the combustion stroke. And, "unburning condition" and "in unburning" are a condition and a time that the controller 50 controls so as not to burn fuel in the combustion stroke.

<Calculation of Shaft Torque in Unburning>

In the burning condition of the internal combustion engine, by referring an unburning condition data in which a relationship between the crank angle θd and the shaft torque in unburning Tcrk_mot is set, the gas pressure torque calculation unit 53 calculates the shaft torque in unburning Tcrk_mot_tdc corresponding to the crank angle θd_tdc in the vicinity of the top dead center.

The crank angle θd_tdc in the vicinity of the top dead center is preliminarily set to a crank angle in the vicinity of the top dead center of the compression stroke. Herein, the vicinity of the top dead center is within an angle interval from 10 degrees before the top dead center to 10 degrees after the top dead center, for example. For example, the crank angle θd_tdc in the vicinity of the top dead center is preliminarily set to the crank angle of the top dead center. The unburning condition data is described below.

As described later, the unburning condition data is set for every operating condition which influences at least the cylinder pressure and the reciprocation inertia torque of the piston. By referring the unburning condition data corresponding to the present operating condition, the gas pressure torque calculation unit 53 calculates the shaft torque in unburning Tcrk_mot_tdc corresponding to the crank angle θd_tdc in the vicinity of the top dead center.

<Calculation of External Load Torque>

Then, the gas pressure torque calculation unit 53 calculates the external load torque in burning Tload_brn, based on the calculated shaft torque in unburning Tcrk_mot_tdc in the vicinity of the top dead center, and the actual shaft torque in burning Tcrkd_brn calculated by the actual shaft torque calculation unit 52 at the crank angle θd_tdc in the vicinity of the top dead center (hereinafter, referred to as an actual shaft torque in burning Tcrkd_brn_tdc in the vicinity of the top dead center).

In the present embodiment, as explained using the equation (8), the gas pressure torque calculation unit 53 calculates the external load torque in burning Tload_brn by subtracting the actual shaft torque in burning Tcrkd_brn_tdc in the vicinity of the top dead center from the shaft torque in unburning Tcrk_mot_tdc in the vicinity of the top dead center, as shown in the next equation.

$$T\text{load_brn}=T\text{crk_mot_tdc}-T\text{crkd_brn_tdc} \quad (9)$$

1-2-3-2. Calculation of Increment of Gas Pressure Torque by Burning

As shown in the next equation obtained by modifying the equation (7), the increment of gas pressure torque by burning ΔTgas_brn can be calculated by subtracting the shaft torque in unburning Tcrk_mot from the shaft torque in burning Tcrk_brn, and adding the external load torque in burning Tload_brn.

$$\Delta T\text{gas_brn}=T\text{crk_brn}-T\text{crk_mot}+T\text{load_brn} \quad (10)$$

Then, in the burning condition of the internal combustion engine, by referring the unburning condition data in which the relationship between the crank angle θd and the shaft torque in unburning Tcrk_mot is set, the gas pressure torque calculation unit 53 calculates the shaft torque in unburning Tcrk_mot corresponding to a crank angle θd_obj of an arithmetic object.

The gas pressure torque calculation unit 53 calculates the increment of gas pressure torque by burning ΔTgas_brn which is included in the gas pressure torque applied to the crankshaft by the gas pressure in the cylinder, at the crank angle θd_obj of the arithmetic object, based on the calculated shaft torque in unburning Tcrk_mot at the crank angle θd_obj of the arithmetic object, the actual shaft torque in burning Tcrkd_brn corresponding to the crank angle θd_obj of the arithmetic object, and the calculated external load torque in burning Tload_brn.

In the present embodiment, as explained using the equation (10), the gas pressure torque calculation unit 53 calculates the increment of gas pressure torque by burning ΔTgas_brn by subtracting the shaft torque in unburning Tcrk_mot from the actual shaft torque in burning Tcrkd_brn, and adding the external load torque in burning Tload_brn, as shown in the next equation.

$$\Delta T\text{gas_brn}=T\text{crk}d\text{_brn}-T\text{crk_brn}+T\text{load_brn} \quad (11)$$

According to the above configuration, the shaft torque in unburning Tcrk_mot is calculated by referring to the unburning condition data in which the relationship between the crank angle θd and the shaft torque in unburning Tcrk_mot is set. The shaft torque in unburning Tcrk_mot includes the gas pressure torque by the cylinder pressures of all cylinders in the case of unburning condition, and the reciprocation inertia torque of the pistons of all cylinders. Therefore, it is not necessary to calculate the reciprocation inertia torque by the crank angle acceleration, using the equation of motion around the crankshaft like the equation (15) of JP 6029726 B. Even if the error component of high frequency is superimposed on the crank angle acceleration, the deterioration of estimation accuracy of the parameter relevant to the combustion state can be suppressed. Since the equation of motion around the crankshaft like the equation (15) of JP 6029726 B is not used, the deterioration of estimation accuracy of the parameter relevant to the combustion state due to the modeling error can be suppressed. Since it is not necessary to calculate separately each of the cylinder pressures of plural unburning cylinders and it is not necessary to calculate separately each of the reciprocation inertia torques of the pistons of plural cylinders like JP 6029726 B, the increase in arithmetic load can be suppressed.

Since the gas pressure torque of the burning cylinder becomes about 0 in the vicinity of the top dead center of the combustion stroke, the external load torque Tload_brn can be calculated with small arithmetic load, based on the shaft torque in unburning Tcrk_mot_tdc in the vicinity of the top dead center calculated with reference to the unburning condition data, and the actual shaft torque in burning Tcrkd_brn_tdc in the vicinity of the top dead center. Then, as the parameter relevant to the combustion state, the increment of gas pressure torque by burning ΔTgas_brn can be calculated with small arithmetic load, based on the shaft torque in unburning Tcrk_mot calculated with reference to the unburning condition data, the actual shaft torque in burning Tcrkd_brn, and the external load torque Tload_brn. Accordingly, even if the error component of high frequency is included in the crank angle acceleration ad and the modeling of the crank mechanism is not easy, the arithmetic load can be reduced while suppressing the deterioration of estimation accuracy of the parameter relevant to the combustion state.

In the case where, due to setting by the experimental data or updating by the actual shaft torque Tcrkd described below, the high frequency error component of the crank angle acceleration which caused by the manufacture error of the tooth of the signal plate is included in the shaft torque in unburning Tcrk_mot of each crank angle θd of the unburning condition data, the high frequency error component can be canceled by subtracting the shaft torque in unburning Tcrk_mot referred to the unburning condition data from the actual shaft torque in burning Tcrkd_brn, when calculating the increment of gas pressure torque by burning ΔTgas_brn, and the calculation accuracy of the increment of gas pressure torque by burning ΔTgas_brn can be suppressed from deteriorating by the high frequency error component.

<Setting of Crank Angle of Arithmetic Object>

The gas pressure torque calculation unit 53 sequentially sets each crank angle θd within a crank angle range corresponding to the combustion stroke, as the crank angle θd_obj of the arithmetic object; and at each set crank angle θd, performs a calculation processing which calculates the increment of gas pressure torque by burning ΔTgas_brn.

For example, the increment of gas pressure torque by burning ΔTgas_brn of each crank angle may be collectively calculated based on the detection value and the calculation value of each crank angle θd stored in the storage apparatus 91, every time when the combustion stroke of each cylinder is ended, or may be calculated every time when each crank angle θd is detected.

The gas pressure torque calculation unit 53 stores the calculated increment of gas pressure torque by burning ΔTgas_brn to the storage apparatus 91 such as RAM, together with angle information such as corresponding the angle identification number n and the crank angle θd, during a period at least longer than the combustion stroke.

<Unburning Condition Data>

The unburning condition data is set for each crank angle θd in the crank angle interval which includes at least the combustion stroke. The unburning condition data is preliminarily set based on the experimental data, and is stored in the storage apparatus 91 such as ROM or EEPROM. In the present embodiment, the unburning condition data which is updated based on the actual shaft torque in unburning Tcrkd_mot by the unburning condition shaft torque learning unit 56 described below is used.

The unburning condition data may be set corresponding to the combustion stroke of each cylinder. For example, the unburning condition data may be set for each crank angle θd of the four cycles.

The unburning condition data is set for every operating condition which influences at least the cylinder pressure and the reciprocation inertia torque of the piston. By referring the unburning condition data corresponding to the present operating condition, the gas pressure torque calculation unit 53 calculates the shaft torque in unburning Tcrk_mot corresponding to each crank angle θd.

The shaft torque in unburning Tcrk_mot changes according to the operating condition which influences at least the cylinder pressure and the reciprocation inertia torque of the piston. According to the above configuration, since the unburning condition data is set for every operating condition, and the unburning condition data corresponding to the present operating condition is referred, the calculation accuracy of the shaft torque in unburning Tcrk_mot can be improved.

In the present embodiment, the operating condition concerning setting of the unburning condition data is set to any one or more of the rotational speed of the internal combustion engine, the intake gas amount in the cylinder, the temperature, and the opening and closing timing of one or both of the intake valve and the exhaust valve. The rotational speed of the internal combustion engine corresponds to the crank angle speed ωd. As the intake gas amount in the cylinder, the gas amount of EGR gas and air taken into the cylinder, the charging efficiency, the gas pressure in intake pipe (in this example, the pressure in the intake manifold), or the like is used. As the temperature, the gas temperature taken into the cylinder, the cooling water temperature, the oil temperature, or the like is used. As the opening and closing timing of the intake valve, the opening and closing timing of the intake valve by the intake variable valve timing mechanism 14 is used. As the opening and closing timing of the exhaust valve, the opening and closing timing of the exhaust valve by the exhaust variable valve timing mechanism 15 is used.

For example, as the unburning condition data, the map data in which a relationship between the crank angle θd and the shaft torque in unburning Tcrk_mot as shown in FIG. 9 is set for every operating condition is stored in the storage apparatus 91. An approximation equation such as a polynomial may be used instead of the map data. Alternatively, as the unburning condition data, a high order function, such as a neural network to which a plurality of operating conditions and the crank angle θd are inputted and which outputs the shaft torque in unburning Tcrk_mot, may be used.

<External Load Torque Included in Shaft Torque in Unburning>

As shown in the next equation, if the external load torque in unburning Tload_mot is included in the shaft torque in unburning Tcrk_mot, an error due to the external load torque in unburning Tload_mot is included in the external load torque in burning Tload_brn calculated by the equation (9).

$$Tload_brn=(Tcrk_mot_tdc-Tload_mot)-Tcrkd_brn_tdc \tag{12}$$

However, even in this case, as shown in the next equation, when calculating the increment of gas pressure torque by burning ΔTgas_brn by the equation (11), the error of the external load torque in unburning Tload_mot included in the external load torque in burning Tload_brn is canceled by the external load torque in unburning Tload_mot included in the shaft torque in unburning Tcrk_mot, and the calculation accuracy of the increment of gas pressure torque by burning ΔTgas_brn is not deteriorated. Accordingly, the external load torque in unburning Tload_mot may or may not be included in the shaft torque in unburning Tcrk_mot.

$$\begin{aligned}\Delta Tgas_brn &= Tcrkd_brn-(Tcrk_mot-Tload_mot)+Tload_brn\\ &= Tcrkd_brn-(Tcrk_mot-Tload_mot)+(Tcrk_mot_tdc-Tload_mot)-Tcrkd_brn_tdc\\ &= Tcrkd_brn-Tcrk_mot+(Tcrk_mot_tdc-Tcrkd_brn_tdc)\end{aligned} \tag{13}$$

1-2-4. Combustion State Estimation Unit 54

The combustion state estimation unit 54 estimates a combustion state of the internal combustion engine, based on the increment of gas pressure torque by burning ΔTgas_brn.

In the present embodiment, the combustion state estimation unit 54 is provided with a cylinder pressure calculation unit 541 and a combustion parameter calculation unit 542.

1-2-4-1. Cylinder Pressure Calculation Unit 541

<Calculation of Cylinder Pressure in Unburning>

In the burning condition of the internal combustion engine, the cylinder pressure calculation unit 541 calculates the cylinder pressure in unburning Pcyl_mot at the crank angle θd_obj of the arithmetic object when assuming that it is not burning, based on the present gas pressure in intake pipe Pin and the crank angle θd_obj of the arithmetic object.

In the present embodiment, the cylinder pressure calculation unit 541 calculates the cylinder pressure in unburning Pcyl_mot, using the next equation expressing the polytrophic change.

$$\text{Pcyl_mot} = \left(\frac{Vcyl0}{\text{Vcyl_}\theta}\right)^{Nply} \times \text{Pin} \tag{14}$$

$$\text{Vcyl_}\theta = Vcyl0 - Sp \times r\left\{\begin{array}{l}(1+\cos(\theta\text{d_obj})) - \\ \frac{r}{L}(1+\cos(2\times\theta\text{d_obj}))\end{array}\right\}$$

Herein, Nply is a polytrophic index, and a preliminarily set value is used. Vcyl0 is the cylinder volume of the burning cylinder at valve closing of the intake valve. A preliminarily set value may be used for Vcyl0, or Vcyl0 may be changed according to the valve closing timing of the intake valve by the intake variable valve timing mechanism 14. Vcly_θ is the cylinder volume of the burning cylinder at the crank angle θd_obj of the arithmetic object. Sp is the projection area of the top face of the piston. r is the crank length. L is the length of the connecting rod. As the crank angle θd_obj of the arithmetic object used for the calculation of the trigonometric function, the angle that the top dead center of the compression stroke of the burning cylinder is set to 0 degree is used.

Instead of the second equation of the equation (14), data (for example, map data, approximation equation, or the like) in which a relationship between the crank angle θd and the cylinder volume Vcly_θ of the burning cylinder is preliminarily set may be used. Instead of the equation (14), data (for example, map data, approximation equation, or the like) in which a relationship between the crank angle θd and the cylinder pressure in unburning Pcyl_mot is preliminarily set may be used. As the gas pressure in intake pipe Pin, the pressure in the intake manifold is used. The pressure detected near the valve closing timing of the intake valve may be used. But, the pressure detected at other near timing or an average value of the pressure may be used.

<Calculation of Cylinder Pressure in Burning>

Then, the cylinder pressure calculation unit 541 calculates a cylinder pressure in burning Pcyl_brn at the crank angle θd_obj of the arithmetic object, based on the increment of gas pressure torque by burning ΔTgas_brn at the crank angle θd_obj of the arithmetic object, and the cylinder pressure in burning Pcyl_brn at the crank angle θd_obj of the arithmetic object.

In the present embodiment, the cylinder pressure calculation unit 541 calculates an increment of cylinder pressure by burning ΔPcyl_brn at the crank angle θd_obj of the arithmetic object, based on the increment of gas pressure torque by burning ΔTgas_brn at the crank angle θd_obj of the arithmetic object, and the crank angle θd_obj of the arithmetic object. For example, the cylinder pressure calculation unit 541 calculates the increment of cylinder pressure by burning ΔPcyl_brn using the next equation.

$$\Delta\text{Pcyl_brn} = \frac{\Delta\text{Tgas_brn}}{Sp \times Rb} \tag{15}$$

$$Rb = r \times (\sin(\theta\text{d_obj}) + \tan(\phi) \times \cos(\theta\text{d_obj}))$$

Herein, Sp is a projection area of the top face of the piston. Rb is a conversion coefficient which converts force generated on the piston of the burning cylinder into torque. R is a length of the crank. φ is an angle of the connecting rod of the burning cylinder, and is calculated based on a connecting rod ratio which is a ratio of the crank length r and the connecting rod length L, and the crank angle θd_obj. As the crank angle θd_obj of the arithmetic object used for the calculation of the trigonometric function, the angle that the top dead center of the compression stroke of the burning cylinder is set to 0 degree is used. Instead of the second equation of the equation (15), data (for example, map data, approximation equation, or the like) in which a relationship between the crank angle θd and the conversion coefficient Rb is preliminarily set may be used.

Then, as shown in the next equation, the cylinder pressure calculation unit 541 calculates the cylinder pressure in burning Pcyl_brn by adding the cylinder pressure in unburning Pcyl_mot and the increment of cylinder pressure by burning ΔPcyl_brn, at the crank angle θd_obj of the arithmetic object.

$$P\text{cyl_brn} = P\text{cyl_mot} + \Delta P\text{cyl_brn} \tag{16}$$

The cylinder pressure calculation unit 541 sequentially sets each crank angle θd within a crank angle range corresponding to the combustion stroke, as the crank angle θd_obj of the arithmetic object; and at each set crank angle θd, performs calculation processing which calculates the cylinder pressure in burning Pcyl_brn.

For example, the cylinder pressure in burning Pcyl_brn of each crank angle may be collectively calculated based on the detection value and the calculation value of each crank angle θd stored in the storage apparatus 91, every time when the combustion stroke of each cylinder is ended, or may be calculated every time when each crank angle θd is detected.

The cylinder pressure calculation unit 541 stores the cylinder pressure in burning Pcyl_brn to the storage apparatus 91 such as RAM, together with angle information such as corresponding the angle identification number n and the crank angle θd, during a period at least longer than the combustion stroke.

1-2-4-2. Combustion Parameter Calculation Unit 542

The combustion parameter calculation unit 542 calculates a combustion parameter showing a combustion state, based on the cylinder pressure in burning Pcyl_brn. For example, at least one or more of a heat release rate, a mass combustion rate MFB, and an indicated mean effective pressure IMEP are calculated as the combustion parameter. Other kind of combustion parameter may be calculated.

In the present embodiment, using the equation (17), the combustion parameter calculation unit 542 calculates the heat release rate dQ/dθd per unit crank angle at the crank angle θd_obj of the arithmetic object.

$$\frac{d(Q)}{d(\theta d)} = \frac{\kappa}{\kappa-1}\text{Pcyl_brn}\frac{d(\text{Vcyl_}\theta)}{d(\theta d)} + \frac{1}{\kappa-1}\text{Vcyl_}\theta\frac{d(\text{Pcyl_brn})}{d(\theta d)} \tag{17}$$

Herein, κ is a ratio of specific heat. Vcly_θ is a cylinder volume of the burning cylinder at the crank angle θd_obj of the arithmetic object, and is calculated as explained using the second equation of the equation (14). The combustion parameter calculation unit 542 sequentially sets each crank angle θd within the crank angle range corresponding to the combustion stroke, as the crank angle θd_obj of the arithmetic object; and at each set crank angle θd, performs a calculation processing which calculates the heat release rate dQ/dθd. The calculated heat release rate dQ/dθd of each crank angle θd_obj of the arithmetic object is stored to the storage apparatus 91, such as RAM, similar to other calculation values.

Using the equation (18), the combustion parameter calculation unit 542 calculates the mass combustion rate MFB of each crank angle θd_obj of the arithmetic object, by dividing a section integral value obtained by integrating the heat release rate dQ/dθd from the combustion start angle θ0 to the crank angle θd_obj of the arithmetic object, by an all integral value Q0 obtained by integrating the heat release rate dQ/dθd for over the whole combustion angle interval. The combustion parameter calculation unit 542 sequentially sets each crank angle θd within the crank angle range corresponding to the combustion stroke, as the crank angle θd_obj of the arithmetic object; and at each set crank angle θd, performs a calculation processing which calculates the mass combustion rate MFB. The calculated mass combustion rate MFB of each crank angle θd_obj of the arithmetic object is stored to the storage apparatus 91, such as RAM, similar to other calculation values.

$$MFB = \frac{\int_{\theta 0}^{\theta d_obj} \frac{d(Q)}{d(\theta d)} d(\theta d)}{Q0} \tag{18}$$

About each burning cylinder, using the equation (19), the combustion parameter calculation unit 542 calculates the indicated mean effective pressure IMEP by integrating the cylinder pressure in burning Pcyl_brn with respect to the cylinder volume Vcly_θ of the burning cylinder.

$$IMEP = \frac{1}{Vcylall} \int_{Vcyls}^{Vcyle} \text{Pcyl_brn}\, d(\text{Vcyl_}\theta) \tag{19}$$

Herein, Vcylall is a stroke volume, Vcyls is a cylinder volume at integral start, and Vclye is a cylinder volume at integral end. The volume interval for integration may be set to a volume interval corresponding to the four cycles, or may be set to a volume interval corresponding to at least the combustion stroke. Vcly_θ is calculated based on the crank angle θd, as shown in the second equation of the equation (14). The combustion parameter calculation unit 542 sequentially sets each crank angle θd as the θd_obj of the arithmetic object; and at each set crank angle θd, performs an integration processing of the cylinder pressure in burning Pcyl_brn.

1-2-5. Combustion Control Unit 55

The combustion control unit 55 performs a combustion control which changes at least one or both of the ignition timing and the EGR amount, based on the combustion parameter. In the present embodiment, the combustion control unit 55 determines a crank angle θd at which the mass combustion rate MFB becomes 0.5 (50%) (referred to as a combustion central angle), and changes at least one or both of the ignition timing and the EGR amount so that the combustion central angle approaches a preliminarily set target angle. For example, when the combustion central angle is on the retard angle side rather than the target angle, the combustion control unit 55 changes the ignition timing to the advance angle side, or decreases the opening degree of the EGR valve 22 so as to decrease the EGR amount. When the EGR amount is decreased, a combustion speed becomes fast and the combustion central angle changes to the advance angle side. On the other hand, when the combustion central angle is on the advance angle side rather than the target angle, the combustion control unit 55 changes the ignition timing to the retard angle side, or increases the opening degree of the EGR valve 22 so as to increase the EGR amount.

Alternatively, the combustion control unit 55 may determine a crank angle θd at which the heat release rate dQ/dθd becomes a maximum value, and change at least one or both of the ignition timing and the EGR amount so that this crank angle θd approaches a preliminarily set target angle.

Alternatively, the combustion control unit 55 may changes at least one or both of the ignition timing and the EGR amount so that the indicated mean effective pressure IMEP approaches a target value which is set for every operating condition.

Other control parameters (for example, the opening and closing timing of the intake valve, the opening and closing timing of the exhaust valve) related to the combustion state may be changed.

1-2-6. Unburning Condition Shaft Torque Learning Unit 56

The unburning condition shaft torque learning unit 56 updates the unburning condition data by the actual shaft torque in unburning Tcrkd_mot calculated at each crank angle θd in the unburning condition of the internal combustion engine.

For example, the unburning condition for updating the unburning condition data is a condition where the fuel cut is carried out, or a condition where the internal combustion engine is driven by the driving force from the outside of the internal combustion engine (for example, driving force of the motor, driving force transmitted from the wheels) in the unburning condition.

In the present embodiment, the unburning condition shaft torque learning unit 56 refers to the unburning condition data stored in the storage apparatus 91 and reads out the shaft torque in unburning Tcrk_mot corresponding to the crank angle θd of the update object; and changes the shaft torque in unburning Tcrk_mot of the crank angle θd of the update object which is set in the unburning condition data stored in the storage apparatus 91, so that the read shaft torque in unburning Tcrk_mot approaches the actual shaft torque in unburning Tcrkd_mot calculated at the crank angle θd of the update object.

A change amount from the initial unburning condition data which is preliminarily set based on experimental data and stored in ROM or EEPROM may be stored in the backup RAM or the like, as a change amount of unburning condition data and be updated. Then, a total value of a value read from the preliminarily set initial unburning condition data and a value read from the change amount of unburning condition data may be used as the final shaft torque in unburning Tcrk_mot.

As mentioned above, in the present embodiment, since the unburning condition data is set for every operating condition, the unburning condition data corresponding to the operating condition in which the actual shaft torque in unburning Tcrkd_mot is calculated is updated. The change amount of unburning condition data is set for every operating condition similar to the initial unburning condition data. In the case where the neural network is used for the unburning condition data or the change amount of unburning condition data, the actual shaft torque in unburning Tcrkd_mot and the like are set as teacher data, and the neural network is learned by the back propagation or the like.

A high pass filter processing which attenuates components of period longer than the stroke period may be performed to the actual shaft torque in unburning Tcrkd_mot used for updating. By this high pass filter processing, the external load torque Tload included in the actual shaft torque in unburning Tcrkd_mot can be reduced, and it can be suppressed that the updated unburning condition data is fluctuated by fluctuation of the external load torque Tload.

The unburning condition shaft torque learning unit 56 may update the shaft torque in unburning Tcrk_mot of each crank angle θd which is set in the unburning condition data, by a value obtained by performing a statistical processing to the actual shaft torques in unburning Tcrkd_mot of plural times which are calculated at each crank angle θd in the combustion strokes of plural times in the unburning condition. As the statistical processing value, an average value, a median, or the like is used. For example, the shaft torque in unburning Tcrk_mot of each crank angle θd set in the unburning condition data is replaced or brought close to the statistical processing value of each crank angle θd.

Alternatively, the unburning condition shaft torque learning unit 56 updates shaft torque in unburning Tcrk_mot of each crank angle θd set as unburning condition data, by a value obtained by performing a low pass filter processing of each crank angle θd to the actual shaft torque in unburning Tcrkd_mot calculated at each crank angle θd in the unburning condition. About each crank angle θd, individually, the filter processing is performed and the filter value is calculated. As the low pass filter processing, for example, the finite impulse response (FIR) filter mentioned above, a first order lag filter, or the like is used. The shaft torque in unburning Tcrk_mot of each crank angle θd set in the unburning condition data is replaced or brought close to the filter value of each crank angle θd.

Outline Flowchart of Whole Processing>

Figure 10:
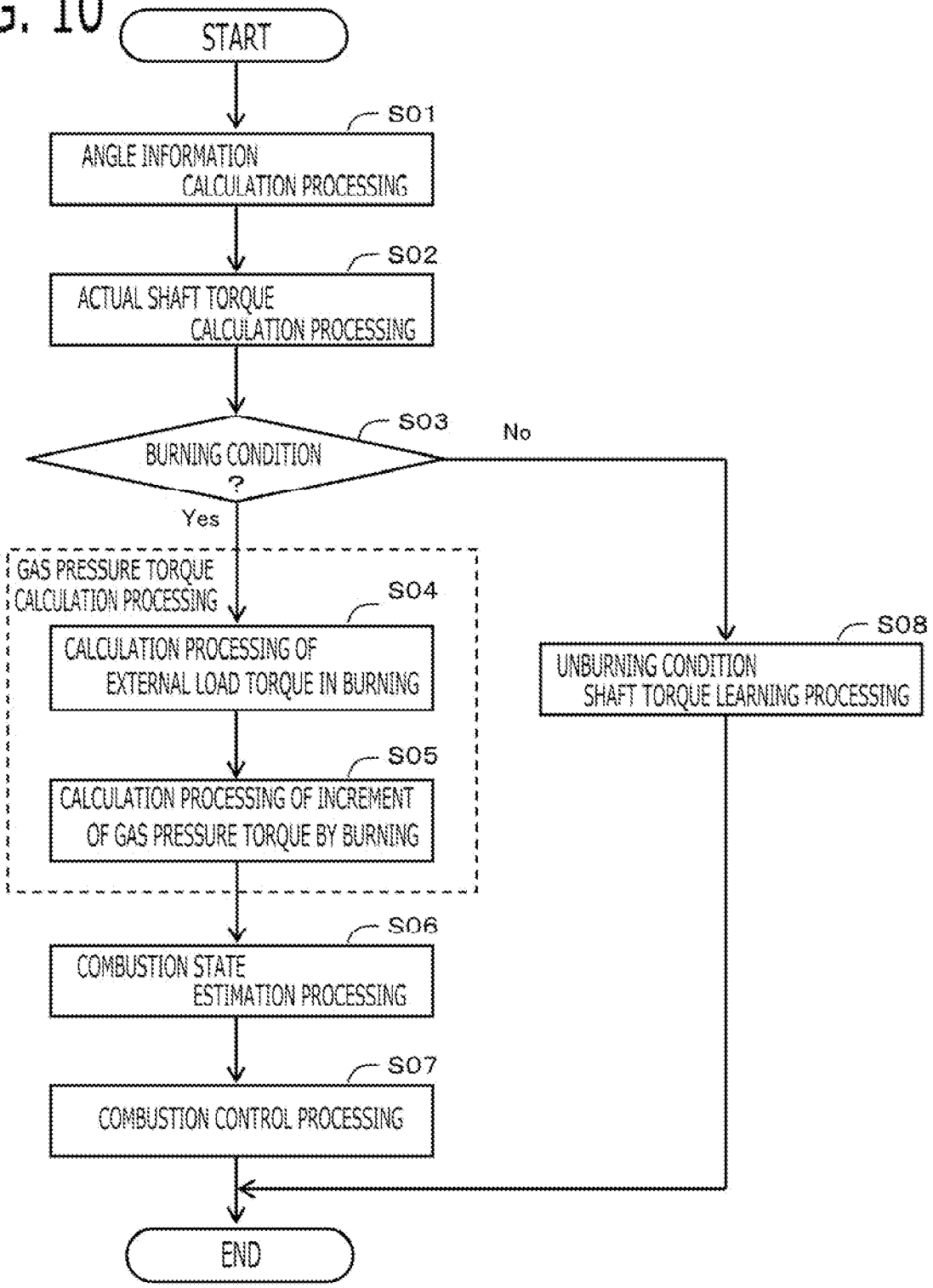
FIG. 10 is a flowchart showing the procedure of schematic processing of the controller according to Embodiment 1.

A procedure of schematic processing of the controller 50 (a control method of internal combustion engine) concerning the present embodiment will be explained based on the flow chart shown in FIG. 10. The processing of the flowchart in FIG. 10 is recurrently executed every time when detecting the crank angle θd or every predetermined operation cycle, by the arithmetic processor 90 executing software (a program) stored in the storage apparatus 91.

In the step S01, as mentioned above, the angle information detection unit 51 performs an angle information detection processing (an angle information detection step) that detects the crank angle θd, the crank angle speed ωd, and the crank angle acceleration αd, based on the output signal of the second crank angle sensor 6.

In the step S02, as mentioned above, the actual shaft torque calculation unit 52 performs an actual shaft torque calculation processing (an actual shaft torque calculation step) that calculates the actual shaft torque Tcrkd applied to the crankshaft, based on the crank angle acceleration ad and the inertia moment Icrk of the crankshaft system.

In the step S03, the controller 50 determines whether it is the burning condition of the internal combustion engine or it is the unburning condition of the internal combustion engine. When it is the burning condition, it advances to the step S04, and when it is the unburning condition, it advances to the step S08. Herein, "the burning condition" and "in burning" are a condition and a time that the controller 50 controls so as to burn fuel in the combustion stroke. And, "the unburning condition" and "in unburning" are a condition and a time that the controller 50 controls so as not to burn fuel in the combustion stroke.

In the step S04, as mentioned above, in the burning condition of the internal combustion engine, by referring the unburning condition data in which the relationship between the crank angle θd and the shaft torque in unburning Tcrk_mot is set, the gas pressure torque calculation unit 53 calculates the shaft torque in unburning Tcrk_mot_tdc corresponding to the crank angle θd_tdc in the vicinity of the top dead center. Then, as mentioned above, the gas pressure torque calculation unit 53 calculates the external load torque in burning Tload_brn, based on the calculated shaft torque in unburning Tcrk_mot_tdc in the vicinity of the top dead center, and the actual shaft torque in burning Tcrkd_brn_tdc in the vicinity of the top dead center calculated by the actual shaft torque calculation unit 52 at the crank angle θd_tdc in the vicinity of the top dead center. The calculation processing of this external load torque in burning Tload_brn is performed once in the one combustion stroke, for example, at the crank angle θd_tdc in the vicinity of the top dead center.

Then, in the step S05, as mentioned above, in the burning condition of the internal combustion engine, by referring the unburning condition data in which the relationship between the crank angle θd and the shaft torque in unburning Tcrk_mot is set, the gas pressure torque calculation unit 53 calculates the shaft torque in unburning Tcrk_mot corresponding to the crank angle θd_obj of the arithmetic object. Then, the gas pressure torque calculation unit 53 calculates the increment of gas pressure torque by burning ΔTgas_brn which is included in the gas pressure torque applied to the crankshaft by the gas pressure in the cylinder, at the crank angle θd_obj of the arithmetic object, based on the calculated shaft torque in unburning Tcrk_mot at the crank angle θd_obj of the arithmetic object, the actual shaft torque in burning Tcrkd_brn corresponding to the crank angle θd_obj of the arithmetic object, and the calculated external load torque in burning Tload_brn. Each crank angle θd within the crank angle range corresponding to the combustion stroke is sequentially set as the crank angle θd_obj of the arithmetic object; and at each set crank angle θd, the calculation processing which calculates the increment of gas pressure torque by burning ΔTgas_brn is performed. The calculation processing of this increment of gas pressure torque by burning ΔTgas_brn may be sequentially performed at detection of each crank angle θd, or may be performed collectively after the end of the one combustion stroke. The processing of this step S04 and step S05 is referred to as a gas pressure torque calculation processing (a gas pressure torque calculation step).

In the step S06, as mentioned above, the combustion state estimation unit 54 performs a combustion state estimation processing (a combustion state estimation step) which estimates the combustion state of the internal combustion engine, based on the increment of gas pressure torque by burning ΔTgas_brn. In the present embodiment, as mentioned above, in the burning condition of the internal combustion engine, the cylinder pressure calculation unit 541 calculates the cylinder pressure in unburning Pcyl_mot at the crank angle θd_obj of the arithmetic object when assuming that it is not burning, based on the present gas pressure in intake pipe Pin and the crank angle θd_obj of the arithmetic object. Then, as mentioned above, the cylinder pressure calculation unit 541 calculates the cylinder pressure in burning Pcyl_brn at the crank angle θd_obj of the arithmetic object, based on the increment of gas pressure torque by burning ΔTgas_brn at the crank angle θd_obj of the arithmetic object, and the cylinder pressure in burning Pcyl_brn at the crank angle θd_obj of the arithmetic object.

And, as mentioned above, the combustion parameter calculation unit 542 calculates the combustion parameter of one or both of the heat release rate and the mass combustion rate MFB, based on the cylinder pressure in burning Pcyl_brn. The calculation processing of this cylinder pressure in burning Pcyl_brn and the combustion parameter may be sequentially performed at detection of each crank angle θd, or may be performed collectively after the end of the one combustion stroke.

In the step S07, as mentioned above, the combustion control unit 55 performs a combustion control processing (a combustion control step) which changes at least one or both of the ignition timing and the EGR amount, based on the combustion parameter.

On the other hand, in the case of the unburning condition of the internal combustion engine, in the step S08, as mentioned above, the unburning condition shaft torque learning unit 56 performs an unburning condition shaft torque learning processing (an unburning condition shaft torque learning step) which updates the unburning condition data by the actual shaft torque in unburning Tcrkd_mot calculated at each crank angle θd in the unburning condition of the internal combustion engine.

Other Embodiments

Other embodiments of the present disclosure will be described. Each of the configurations of embodiments to be explained below is not limited to be separately utilized but can be utilized in combination with the configurations of other embodiments as long as no discrepancy occurs.

(1) In the above Embodiment 1, there was explained the case where the crank angle θd, the crank angle speed ωd, and the crank angle acceleration ad are detected based on the output signal of the second crank angle sensor 6. However, based on the output signal of the first crank angle sensor 11, the crank angle θd, the crank angle speed ωd, and the crank angle acceleration αd may be detected.

(2) In the above Embodiment 1, there was explained the case where the 3-cylinder engine whose cylinder number is three is used. However, the engine of any cylinder numbers (for example, 1-cylinder, 2-cylinder, 4-cylinder, 6-cylinder) may be used. Also in the engine of any cylinder numbers, the shaft torque in unburning calculated with reference to the unburning condition data includes the gas pressure torque by the cylinder pressures of all cylinders in the case of unburning condition, and the reciprocation inertia torque of the pistons of all cylinders. Accordingly, as shown in the equation (10), only by subtracting the shaft torque in unburning Tcrk_mot from the actual shaft torque in burning Tcrkd_brn and adding the external load torque Tload_brn, the increment of gas pressure torque by burning ΔTgas_brn can be calculated by simple calculation.

(3) In the above Embodiment 1, there was explained the case where the internal combustion engine 1 is the gasoline engine. However, embodiments of the present disclosure are not limited to the foregoing case. That is to say, the internal combustion engine 1 may be various kinds of internal combustion engines, such as a diesel engine and an engine which performs HCCI combustion (Homogeneous-Charge Compression Ignition Combustion).

(4) In the above Embodiment 1, there was explained the case where the controller 50 calculates the cylinder pressure in burning Pcyl_brn based on the increment of gas pressure torque by burning ΔTgas_brn and the like, calculates the combustion parameter of one or both of the heat release rate and the mass combustion rate MFB based on the cylinder pressure in burning Pcyl_brn, and estimates the combustion state of the internal combustion engine. However, without calculating the cylinder pressure in burning Pcyl_brn and the combustion parameter, the controller 50 may estimate the combustion state based on a behavior of the increment of gas pressure torque by burning ΔTgas_brn (for example, an integration value in the combustion stroke, a peak value in the combustion stroke, the crank angle at the peak value, or the like). Alternatively, without calculating the combustion parameter, the controller 50 may estimate the combustion state based on a behavior of the cylinder pressure in burning Pcyl_brn (for example, an integration value in the combustion stroke, a peak value in the combustion stroke, the crank angle at the peak value, or the like).

(5) In the above Embodiment 1, there was explained the case where the controller 50 calculates the heat release rate and the mass combustion rate based on the cylinder pressure in burning Pcyl_brn, and performs the combustion control. However, the controller 50 may perform other controls, such as a misfire detection of burning cylinder, based on the increment of gas pressure torque by burning ΔTgas_brn, the cylinder pressure in burning Pcyl_brn, or the heat release rate.

Although the present disclosure is described above in terms of an exemplary embodiment, it should be understood that the various features, aspects and functionality described in the embodiment are not limited in their applicability to the particular embodiment with which they are described, but instead can be applied, alone or in various combinations to the embodiment. It is therefore understood that numerous modifications which have not been exemplified can be devised without departing from the scope of the present disclosure. For example, at least one of the constituent components may be modified, added, or eliminated.

What is claimed is:

1. A controller for internal combustion engine comprising at least one processor configured to implement:

an angle information detector that detects a crank angle and a crank angle acceleration, based on an output signal of a crank angle sensor;

an actual shaft torque calculator that calculates an actual shaft torque applied to a crankshaft, based on the crank angle acceleration and an inertia moment of a crankshaft system; and a gas pressure torque calculator that, in a burning condition of an internal combustion engine, by referring to an unburning condition data in which a relationship between the crank angle and a shaft torque in unburning is set, calculates the shaft torque in unburning corresponding to a crank angle in a vicinity of a top dead center of a combustion stroke;

calculates an external load torque which is a torque applied to the crankshaft from an outside of the internal combustion engine, based on the calculated shaft torque in unburning in the vicinity of the top dead center, and the actual shaft torque in burning calculated by the actual shaft torque calculator at the crank angle in the vicinity of the top dead center;

by referring the unburning condition data, calculates the shaft torque in unburning corresponding to a crank angle of an arithmetic object;

calculates an increment of gas pressure torque by burning which is included in a gas pressure torque applied to the crankshaft by a gas pressure in cylinder, at the crank angle of the arithmetic object, based on the calculated shaft torque in unburning at the crank angle of the arithmetic object, the actual shaft torque in burning corresponding to the crank angle of the arithmetic object, and the calculated external load torque; and a combustion controller that changes at least one or both of an ignition timing and an EGR amount, based on the increment of gas pressure torque by burning at the crank angle of the arithmetic object.

2. The controller for internal combustion engine according to claim 1, wherein the gas pressure torque calculator sequentially sets each crank angle within a crank angle range corresponding to the combustion stroke, as the crank angle of the arithmetic object; and at each set crank angle, performs a calculation processing which calculates the increment of gas pressure torque by burning.

3. The controller for internal combustion engine according to claim 1, further comprising a combustion state estimator that estimates a combustion state of the internal combustion engine, based on the increment of gas pressure torque by burning.

4. The controller for internal combustion engine according to claim 1, further comprising a cylinder pressure calculator that, in the burning condition of the internal combustion engine, calculates a cylinder pressure in unburning at the crank angle of the arithmetic object when assuming that it is not burning, based on a present gas pressure in intake pipe, and the crank angle of the arithmetic object; and calculates a cylinder pressure in burning at the crank angle of the arithmetic object, based on the calculated cylinder pressure in unburning at the crank angle of the arithmetic object, and the increment of gas pressure torque by burning at the crank angle of the arithmetic object.

5. The controller for internal combustion engine according to claim 4, further comprising:

a combustion parameter calculator that calculates a combustion parameter showing a combustion state, based on the cylinder pressure in burning, wherein the combustion controller changes the at least one or both of the ignition timing and the EGR amount, based on the combustion parameter.

6. The controller for internal combustion engine according to claim 1, wherein the unburning condition data is set for every operating condition including at least any one or more of a rotational speed of the internal combustion engine, an intake gas amount in cylinder, a temperature of the internal combustion engine, and an opening and closing timing of one or both of an intake valve and an exhaust valve; and wherein the gas pressure torque calculator calculates the shaft torque in unburning, by referring to the unburning condition data corresponding to a present operating condition.

7. The controller for internal combustion engine according to claim 1, wherein the angle information detector performs a filter processing which removes a high frequency component, when calculating the crank angle acceleration.

8. The controller for internal combustion engine according to claim 7, wherein the angle information detector performs the filter processing with the same filter characteristics between the unburning condition and the burning condition.

9. The controller for internal combustion engine according to claim 1, further comprising an unburning condition shaft torque learning calculator that updates the unburning condition data by the actual shaft torque in unburning calculated at each crank angle in the unburning condition of the internal combustion engine.

10. The controller for internal combustion engine according to claim 9, wherein the unburning condition where the unburning condition data is updated is a condition where the fuel cut is performed.

11. The controller for internal combustion engine according to claim 9, wherein the unburning condition shaft torque learning calculator updates the shaft torque in unburning of each crank angle which is set in the unburning condition data, by a value obtained by performing a statistical processing to the actual shaft torques in unburning of plural times which are calculated at each crank angle in the combustion strokes of plural times in the unburning condition.

12. The controller for internal combustion engine according to claim 9, wherein the unburning condition shaft torque learning calculator updates the shaft torque in unburning of each crank angle which is set in the unburning condition data, by a value obtained by performing a low pass filter processing of each crank angle to the actual shaft torque in unburning calculated at each crank angle in the unburning condition.

13. A control method for internal combustion engine, the control method comprising:

detecting a crank angle and a crank angle acceleration, based on an output signal of a crank angle sensor;

calculating an actual shaft torque applied to a crankshaft, based on the crank angle acceleration and an inertia moment of a crankshaft system;

calculating, in a burning condition of an internal combustion engine, by referring an unburning condition data in which a relationship between the crank angle and a shaft torque in unburning is set, the shaft torque in unburning corresponding to a crank angle in a vicinity of a top dead center of a combustion stroke;

calculating an external load torque which is a torque applied to the crankshaft from an outside of the internal combustion engine, based on the calculated shaft torque in unburning in the vicinity of the top dead center, and the actual shaft torque in burning calculated in the actual shaft torque calculating at the crank angle in the vicinity of the top dead center;

by referring the unburning condition data, calculating the shaft torque in unburning corresponding to a crank angle of an arithmetic object;

calculating an increment of gas pressure torque by burning which is included in a gas pressure torque applied to the crankshaft by a gas pressure in cylinder, at the crank angle of the arithmetic object, based on the calculated shaft torque in unburning at the crank angle of the arithmetic object, the actual shaft torque in burning corresponding to the crank angle of the arithmetic object, and the calculated external load torque; and changing at least one or both of an ignition timing and an EGR amount, based on the increment of gas pressure torque by burning at the crank angle of the arithmetic object.

* * * * *